United States Patent [19]

Wang et al.

[11] 4,371,195

[45] Feb. 1, 1983

[54] COVER WITH ADHESIVE BRIDGES IN SCORED AREAS

[75] Inventors: James C. Wang, Libertyville; Donald Murfitt, Glenview; Paul H. Livingston, Hoffman Estates, all of Ill.

[73] Assignee: General Binding Corporation, Northbrook, Ill.

[21] Appl. No.: 162,608

[22] Filed: Jun. 24, 1980

[51] Int. Cl.[3] ..... B42D 3/00; B42C 9/00

[52] U.S. Cl. ..... 281/21 R; 281/29; 412/37

[58] Field of Search ..... 281/21 R, 29; 11/1 AD

[56] References Cited

U.S. PATENT DOCUMENTS

| | | | |
|---|---|---|---|
| 3,847,718 | 11/1974 | Watson | 281/21 R |
| 3,957,287 | 5/1976 | Hall | 281/29 X |
| 3,964,770 | 6/1976 | Abildgaard | 281/29 |
| 3,973,787 | 8/1976 | Staats | 281/21 R |
| 4,129,471 | 12/1978 | Rome | 281/21 R X |
| 4,141,100 | 2/1979 | Domroe | 281/21 R X |
| 4,289,330 | 9/1981 | Wiermanski | 11/1 AD X |

*Primary Examiner*—Paul A. Bell
*Assistant Examiner*—John S. Brown
*Attorney, Agent, or Firm*—Hill, Van Santen, Steadman, Chiara & Simpson

[57] ABSTRACT

An improved book cover structure of the general type having an integral backbone and front and back covers connected to the backbone via spaced parallel score lines to enable the front and back covers to flex relative to the backbone. A backbone strip of hot melt adhesive is secured on an inside face area of the backbone. Spacer means for positioning the outermost sheets in engagement with the backbone strip are provided and comprise cover strips of hot melt adhesive secured to inside surface areas of the front and back covers adjacent to the score lines with reduced area portions of the cover strips extending across the score lines.

14 Claims, 10 Drawing Figures

COVER WITH ADHESIVE BRIDGES IN SCORED AREAS

BACKGROUND OF THE INVENTION

As those familiar with the stationery arts are aware, sheets of paper, or the like, have been bound together at one edge through the medium of resilient adhesive. A well known example of this technique is seen in the typical "pad" of paper in which the individual sheets are sequentially usable and removable from the pad by physical disengagement from the adhesive. In such binding systems, the sheets have been physically clamped to provide a maximum compression adjacent the edge to be supplied with adhesive. With the clamped sheets thus positioned, an adhesive material has been applied to the exposed edge. Such a system has been similarly applied to pamphlets, books, and the like, utilizing apparatus designed to first stack the sheets in aligned condition and then rigidly clamp the sheets adjacent the edge to be glued. Many books have been bound utilizing such prior art systems. However, for typical office or home use, the apparatus envisaged for such binding procedures has been extremely expensive and has required relatively skilled personnel for its successful operation. In the main, bookbinding done under such circumstances has required large manufacturing facilities and has been done on a high-volume basis only. At the same time, means have continually been sought permitting simple edge-binding. Although simplifications have been attempted in the formerly employed clamping systems, continued research led to the development of bookbinding systems disclosed in U.S. Pat. No. 3,973,787 for use in an ordinary office and home operation. And FIGS. 1-4 and FIGS. 12, 13 and 15 among others show the state of the art prior to the development of the present invention. With the bookbinding system shown in U.S. Pat. No. 3,973,787 hot melt adhesive strips of the new type disclosed in this application were not known or previously employed.

SUMMARY OF THE INVENTION

In accordance with the present invention, a thermally activatible adhesive is combined with a loosely gathered sheaf of sheets. The gathered sheets are jogged or otherwise aligned so that the edge thereof to be bound lies horizontally upon a layer of adhesive positioned on a backbone between a pair of hot melt adhesive strips provided on inside surface areas of front and back covers of a book cover structure which pair of hot melt adhesive strips provide means for securing the jogging sheets in engagement with the backbone strip of hot melt adhesive once the hot melt adhesive strips have been heated to secure the strips in assembly with the sheets. In accordance with important features of this invention, adhesive strips are disposed in parallel relation on opposite sides of a centrally located hot melt adhesive strip adhered to a backbone of a book cover structure with front and back covers being connected to the backbone along parallel scribes or scorelines positioned adjacent to and between the hot melt strips and with reduced volume bridging means extending between strips across the scorelines. Stated another way, a very important feature of this invention concerns a book cover structure having a pair of hot melt adhesive strips positioned in parallel relation on opposite sides of a backbone of a book cover with ribs or bridges of adhesive being arranged to extend sideways to connect the cover side strips to the backbone strip. The bridges or ribs may take various forms, and, although not preferred, some of the ribs may only extend to the proximity of the hot melt adhesive strip carried on the backbone, without actually touching the same.

According to a major feature of this invention, the ribs should extend across the scoreline defining the juncture between the cover and the backbone to achieve the improved results as hereafter described in further detail.

An important feature of the invention is that the described adhesive bridges will prevent sheets from falling into the scored bare gaps between adhesive strips, before binding and at the initial period of binding. Later, in the binding process, when the adhesive is melted, the sheets on them move downwardly to anchor themselves into ahesive for good binding.

Previous experiments show that when a uniform adhesive layer is extended outwardly from the backbone strips, over and beyond the scorelines of a binding cover, a satisfactory fold cannot be made, even though the layer is only 6 mil thick. However, it was discovered that when thick cover strips were used and the layer was made discontinuous, good folds could be made even with the rather thick adhesive ribs presented across the scores. It was then observed that the use of transverse ribs permits an amount of adhesive in the score only a small percentage overall, and the resistance to cold folding and the tendency to spring back are small.

Another surprising discovery was that these adhesive ribs tend to help adhesive to flow into the bare areas between strips when the heat is applied to form a book and to transfer heat to the side strips on the cover. These phenomena significantly improve the assurance of forming rigid hinges at corners of the backbone or spine, a criterion for well bound books. It is believed that improved heat transfer from the backbone adhesive through the ribs to the side strip and a decreased surface tension due to the presence of ribs in the scored areas explains the fast adhesive flow into the bare area and improved melting action.

One embodiment of the invention was reduced to practice by establishing a form of "draw resonance" phenomenum relative to the side strips of adhesive. The "draw resonance" phenomenum has been previously observed as a detrimental factor in a certain visco-elastic polymer processing technology such as plastic films manufacturing, but is, as yet, not well understood. It refers to the fact that under some circumstances when extruding visco-elastic materials, a "chatter" pattern appears on the extrusion. In prior art, draw resonance is an undesired occurrence in polymer processing. This is the first time known to applicants that such a phenomenum has been used for a useful purpose.

The adhesive used in the above-mentioned process should have adequate visco-elastic properties as to exhibit the aforesaid "draw resonance" phenomenum at proper conditions to form the desired geometry. Also, the viscosity properties and melting temperature of the adhesive should be in the proper range as to perform well in the binding machines in which the cover is intended to be used.

Other objects and features of this invention will become more fully apparent in view of the following detailed description of the drawings illustrating a single embodiment and wherein.

DETAILED DESCRIPTION OF THE DRAWINGS

Figure 1:
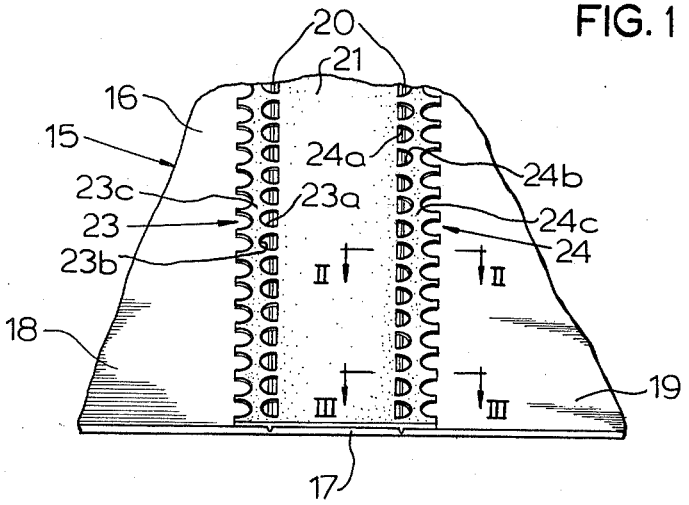
FIG. 1 is a fragmentary plan view of an open book cover structure carrying hot melt adhesive strips embodying important features of our invention.
Figure 2:
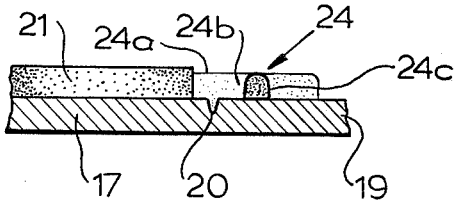
FIG. 2 is an enlarged fragmentary cross-sectional view taken substantially on the line II—II looking in the direction indicated in the arrows as seen in FIG. 1.
Figure 3:
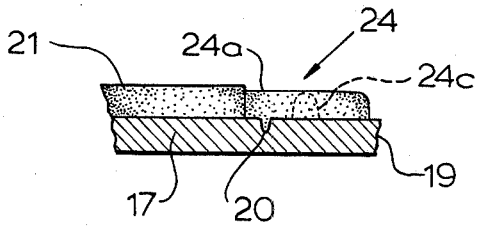
FIG. 3 is an enlarged fragmentary cross-sectional view taken substantially on the line III—III in FIG. 1.
Figure 4:
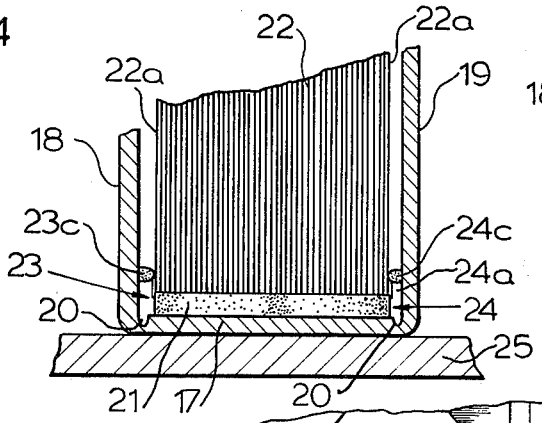
FIG. 4 is an enlarged fragmentary vertical section with parts shown in elevation illustrating the cover structure position upon a hot plate in readiness for heat to be applied to secure the sheets or pages in integral assembly with the cover structure.

According to the present invention, a book cover structure 15 includes a book cover 16 having a backbone 17 with a front cover 18 and a back cover 19 secured in assembly therewith. Scores 20 separate the front and back cover 18 and 19 from the backbone 17. A strip of hot melt adhesive 21 may be applied to the backbone 17 in the manner described in U.S. Pat. No. 3,973,787.

Figure 5:
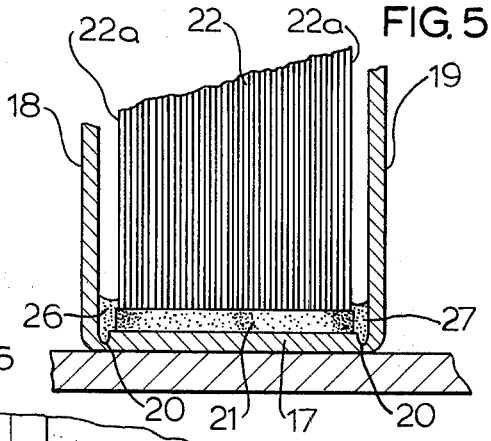
FIG. 5 is an enlarged vertical section similar to FIG. 4 only illustrating the appearance of the components shown in FIG. 4 after heat has been applied and illustrating the sheets or pages in integral assembly with the bookcover structure.

When a consumer is desirous of binding sheets 22 with a book cover 16, sheets 22 are placed on top of the backbone strip of adhesive 21 in edgewise relation thereto. In the manufacturing of a first embodiment of the book cover 16, cover strips 23 and 24 are secured with inside face areas or surface areas of the front and back covers 18 and 19 contemporaneously with the securement of the backbone strip of adhesive 21, all as is shown in FIGS. 1 and 5. The strips 23 and 24 are comprised of a series of transversely extending ribs **23*a* and 24*a* separated by rib grooves or valleys 23*b* and 24*b*. The strips 23 and 24 have a strip base or strip connecting portion 23*c* and 24*c* which serves to connect all of the associated ribs on each strip together. Each of the strips 21, 23, and 24** preferably have an adhesive thickness of approximately thirty-thousandths of an inch.

The sheets 22 can be bound to the book cover 16 to form a book cover structure 15 by using a hot plate or heater 25 operating the same as disclosed in U.S. Pat. No. 3,973,787 with particular reference to the description provided in columns 5 and 6 of that patent.

An examination of adhesive materials that are satisfactory for the present method shows that a large number of so-called "hot-melt" adhesives are available having in the range of 20–40 percent of ethylene vinyl acetate of a medium to a high viscosity in combination with about 20% tackifier, ordinarily a natural resin, with the balance of microcrystalline wax as a carrier with a melt point on the order of 150° F.–160° F. It is desirable that the melt temperature of the adhesive composite approximate 220° F., and that the adhesive be remeltable so that additional pages may be added later, if desired.

A typical cover may, as above noted, comprise paper card, or similar, stock. Preferably, the backbone 17 is then spread with a layer of the termally activated or hot-melt adhesive. We have found that the application of such a cover, with its adhesive, to a heater at a temperature on the order of 325° F. for a relatively short period of time does not appreciably adversely affect the cover or its contents.

The heater or plate 25 that is used to melt the adhesive strip 21 can be of any suitable type. As an example, the hot plate or heater 25 can be constructed and operated in the same way as the heater 20 described in U.S. Pat. No. 3,973,787.

As seen in FIG. 1, the adhesive ribs **23*a*, 24*a* extend sideways to connect the side strips 23,24 to the center strip 21. In some cases, the ribs may be extended only to the proximity of the center strip without actually touching it, but in any case, the ribs should extend across the scored area. Accordingly, the described adhesive "ribs" will prevent sheets from falling into the otherwise bare gaps between adhesive strips, before binding and at the initial period of binding. Later, during the binding process, and after the heat melts the backbone strips 21**, the heat will melt the adhesive ribs so that the sheets resting on them will move down to anchor themselves into adhesive for good binding. It was surprising to discover that when the ribs were made narrow good folds were readily accomplished even though adhesive is presented in the scored area. At the narrowest point of the ribs, the amount of adhesive in the score constitutes only a very small percentage compared with the bare area and the resistance to fold and the tendency to spring back is virtually negligible.

Any suitable material may be used for the manufacture of the bindings or book covers 16 and preferred materials are discussed in the prior art. In this connection, attention is directed to column 6 of the aforesaid U.S. Pat. No. 3,973,787. Also, with respect to the pages or sheets 22, these sheets may be made from any suitable material such as is described in column 6 and 7 of the U.S. Pat. No. 3,973,787.

Figure 6:
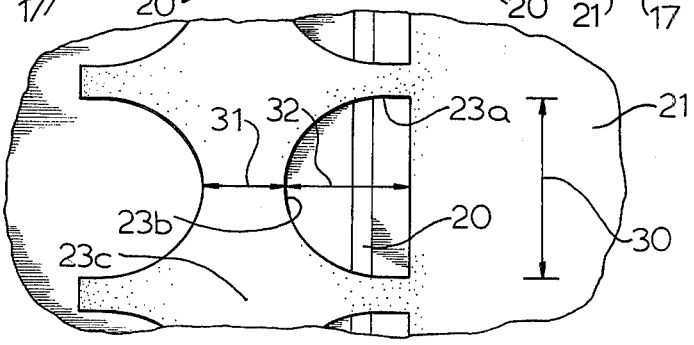
FIG. 6 is an enlarged partial view of the adhesive pattern.

For the purpose of further describing a preferred embodiment, attention is directed to FIG. 6. Here an enlarged view has been presented for the purpose of illustrating certain dimensional relationships. It will be appreciated that here the desired amount of glue is placed upon the covers 18 and 19 in the form of ribbed strips 23 and 24. More particularly, the reference numeral 30 indicates a distance between the ribs on the order of 5/64". The reference numeral 31 indicates that the width of the strip 23C may be of the order of about 5/64". Also, the depth of the groove 23B is shown at 32 to be about 5/64". While these relationships can be varied, it will be appreciated that excellent results can be attained when the spacings 30, 31 and 32 are made in accordance with the dimensions just described.

As noted above, a chattered configuration may be obtained by varying the flow of hot adhesive onto the cover through a conventional hot melt extrusion orifice, until the flow pulses, providing the jagged appearing strips 23. A bridge or rib in accordance with the present invention may also be provided in the modified embodiments shown in FIGS. 7–11.

Figure 7:
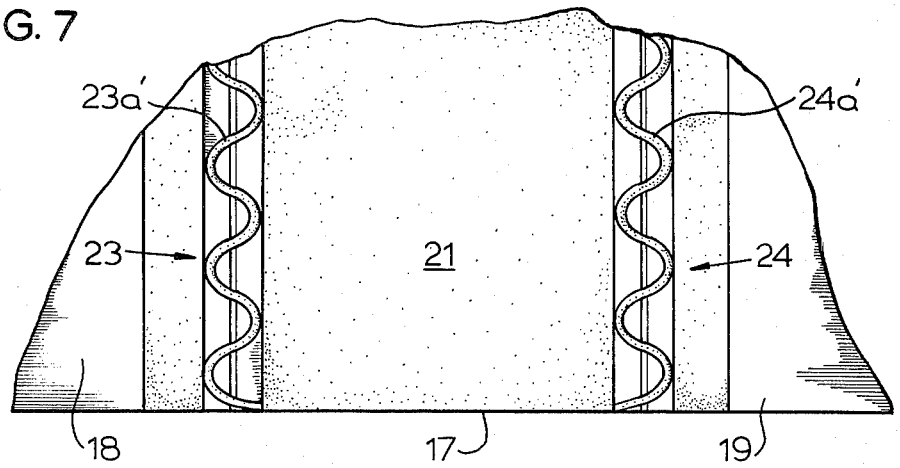
FIG. 7 is a fragmentary view of an open book cover structure similar to FIG. 1 and illustrating a modified form of the invention.

In the arrangement shown in FIG. 7 the bridge or rib is provided in the form of a serpentine track of hot melt that may be laid onto the cover by a sidewise-oscillating extrusion die. As in the case of the first embodiment, a small spaced volume of adhesive appears on the score lines, permitting cold folding to occur, while providing a least some adhesive for paper contact between strips 21 and 23 or 24 no matter where the sheet falls between the strips.

Figure 8:
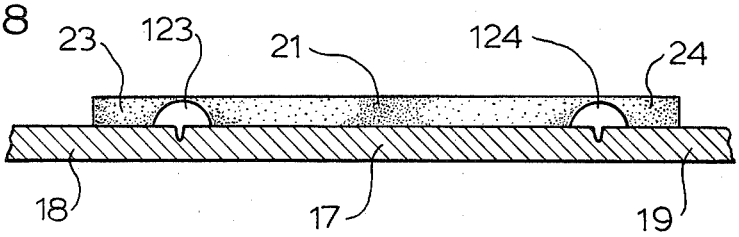
FIG. 8 is a cross-sectional view of a further embodiment of the invention similar to the view in FIG. 2 wherein the bridge is of tunnel configuration.
Figure 9:
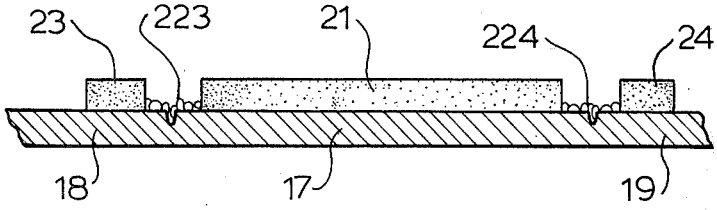
FIG. 9 is a cross-sectional view of another embodiment of the invention in which random dots of adhesive are employed as a bridge.
Figure 10:
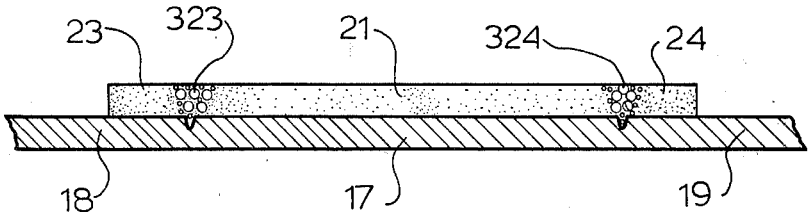
FIG. 10 is still another embodiment of the invention in which the bridge comprises a foamed area, largely air bubbles.

Other variations of the invention include providing an air tunnel space as at 123, 124 in FIG. 8, a plurality of randomly spaced dots of adhesive as at 223,224 in FIG. 9, and largely-gas foamed adhesive areas 323,324 in FIG. 10. Each of these variants provides substantially improved foldability while eliminating poor page retention at the edges of the backbone and also provides improved heat conduction during the book assembly process. Of course, other variations may be employed without departing from the scope of the present invention, and accordingly, it is our intention to be limited solely by the scope of the hereinafter appended claims:

We claim as our invention:

1. A book cover structure of the type having a backbone with front and back covers connected to the backbone and separated from the backbone by spaced parallel score lines to enable the front and back covers to flex relative to the backbone, the improvement comprising a backbone strip of hot melt adhesive being secured on an inside face area of said backbone and means for positioning sheets in engagement with said backbone comprising a pair of cover strips of hot melt adhesive secured to inside surface areas of the front and back covers in spaced adjacency to the score lines, and bridge means of hot melt adhesive extending between adjacent strips and across said score lines, said bridge means having substantially reduced adhesive thickness at, and over said score lines.

2. The cover of claim 1 wherein said bridge means contacts the cover material substantially throughout its path from the backbone strip to the cover strips.

3. The cover of claim 1 wherein the said bridge means provides a tunnel between the backbone strip to the cover strips.

4. The cover according to claims 2 or 3 wherein the bridge means comprises a plurality of spaced connections extending between the backbone strip to the cover strips.

5. The cover of claim 1 wherein said bridge means comprises gas foamed adhesive connecting said backbone strip to the cover strips.

6. The book cover structure of claim 1 further characterized by the bridge means comprising uniformly spaced ribs spaced apart about 5/64".

7. A book cover structure of the type having a backbone with front and back covers connected to the backbone and separated from the backbone by spaced parallel score lines to enable the front and back covers to flex relative to the backbone, the improvement comprising a backbone adhesive strip of hot melt adhesive being secured on an inside face area of said backbone and means for positioning sheets in engagement with said backbone comprising a pair of cover adhesive strips of hot melt adhesive secured to inside surface areas of the front and back covers in spaced adjacency to the score lines, and bridge means of substantially reduced adhesive width and thickness extending across the score lines from the cover adhesive strips to the backbone adhesive strip, the cover strips of hot melt adhesive having a thickness in the range of 0.030" to 0.008", the bridge means including a series of generally transversely extending bridges spaced apart about 5/64" and with each cover strip having a transverse width of about 3/64".

8. A book cover structure of the type having a backbone with front and back covers connected to the backbone and separated from the backbone by spaced parallel score lines to enable the front and back covers to flex relative to the backbone, the improvement comprising a backbone adhesive strip of hot melt adhesive being secured on an inside face area of said backbone and means for positioning sheets in engagement with said backbone comprising a pair of cover adhesive strips of hot melt adhesive secured to inside surface areas of the front and back covers in spaced adjacency to the score lines, and bridge means of substantially reduced adhesive width and thickness extending across the score lines from the cover adhesive strips to the backbone adhesive strips.

9. The book cover structure of claim 8 further characterized by the cover strips of hot melt adhesive having a thickness in the range of 0.030" to 0.008".

10. The book cover structure of claim 9 further characterized by the backbone strip of adhesive having a thickness on the order of 0.030".

11. The book cover structure of claim 8 further characterized by said bridge means comprising a series of generally transversely extending ribs of a few thousandths of an inch width spaced apart about 5/64" and with each cover strip having a transverse width of about 3/64".

12. The book cover structure of claim 8 further characterized by a series of sheets being mounted in edgewise relationship upon said backbone strip of hot melt adhesive inwardly of and between said score lines and with said backbone strip to form a book, the bridge means comprising a series of adhesive ribs extending transversely over the score lines, said pair of cover strips of hot melt adhesive and said ribs all being heated to produce a bond joining lower edges of the sheets with the cover structure.

13. The book cover structure of claim 12 further characterized by said bridge means between the strips of hot melt adhesive being bonded with opposed surface areas of outside ones of said sheets at the areas of said score lines thus providing further securement for the sheets secured to said backbone.

14. A book cover structure of the type having a backbone with front and back covers connected to the backbone and separated from the backbone by spaced parallel score lines to enable the front and back covers to be bent relative to the backbone, the improvement comprising a backbone strip of holt melt adhesive being secured on an inside face area of said backbone, and means for positioning sheets in engagement with said backbone comprising a pair of cover strips of hot melt adhesive secured to inside surface areas of the front and back covers in spaced adjacency to the score lines with bridge portions of said cover strips extending across the score lines between backbone strip and the cover strips, thus providing adhesive over and on opposite sides of, the associated score line, the bridge portions being of substantially reduced adhesive width and thickness where extending across the score lines from the cover adhesive strips to the backbone adhesive strip, the bridge portions when heated and melted producing a bonded area at the associated score line, adhering the adjacent sheet to said backbone and leaving the cover freely flexible along the score line where the cover is joined with the backbone.

* * * * *